US010428408B2

(12) United States Patent
Yamazaki et al.

(10) Patent No.: US 10,428,408 B2
(45) Date of Patent: Oct. 1, 2019

(54) R-T-B-BASED RARE EARTH SINTERED MAGNET AND ALLOY FOR R-T-B-BASED RARE EARTH SINTERED MAGNET

(71) Applicant: TDK Corporation, Tokyo (JP)

(72) Inventors: Takashi Yamazaki, Chichibu (JP); Akifumi Muraoka, Chichibu (JP); Kenichiro Nakajima, Chichibu (JP)

(73) Assignee: TDK Corporation, Tokyo (JP)

( * ) Notice: Subject to any disclaimer, the term of this patent is extended or adjusted under 35 U.S.C. 154(b) by 46 days.

(21) Appl. No.: 15/066,143

(22) Filed: Mar. 10, 2016

(65) Prior Publication Data

US 2016/0268024 A1 Sep. 15, 2016

(30) Foreign Application Priority Data

Mar. 13, 2015 (JP) ..... 2015-051353
Dec. 3, 2015 (JP) ..... 2015-236922

(51) Int. Cl.

| | |
|---|---|
| ***C22C 38/00*** | (2006.01) |
| ***C22C 38/06*** | (2006.01) |
| ***C22C 38/14*** | (2006.01) |
| ***C22C 38/16*** | (2006.01) |
| ***C22C 33/02*** | (2006.01) |
| ***H01F 1/057*** | (2006.01) |
| ***C22C 38/10*** | (2006.01) |
| ***B22F 3/10*** | (2006.01) |

(52) U.S. Cl.

CPC ..... *C22C 38/002* (2013.01); *B22F 3/10* (2013.01); *C22C 33/0278* (2013.01); *C22C 38/005* (2013.01); *C22C 38/06* (2013.01); *C22C 38/10* (2013.01); *C22C 38/14* (2013.01); *C22C 38/16* (2013.01); *H01F 1/0577* (2013.01); *C22C 2202/02* (2013.01)

(58) Field of Classification Search

CPC ..... C22C 38/002; C22C 38/005; C22C 38/06; C22C 38/14; C22C 38/16; C22C 33/0278; C22C 2202/02; H01F 1/0577

USPC ..... 420/83; 148/301, 302, 303; 252/62.57, 252/62.58, 62.6

See application file for complete search history.

(56) References Cited

U.S. PATENT DOCUMENTS

| | | | | |
|---|---|---|---|---|
| 5,167,914 | A * | 12/1992 | Fujimura | H01F 1/0577 148/101 |
| 5,395,462 | A * | 3/1995 | Takeshita | H01F 1/0573 148/302 |
| 6,386,269 | B1 * | 5/2002 | Kanekiyo | C22C 38/002 164/463 |
| 9,558,872 | B2 * | 1/2017 | Yamazaki | H01F 1/0577 |
| 2006/0201585 | A1 | 9/2006 | Tomizawa et al. | |
| 2008/0271821 | A1 | 11/2008 | Tomizawa | |
| 2008/0274009 | A1 | 11/2008 | Tomizawa | |
| 2011/0095855 | A1 * | 4/2011 | Kuniyoshi | H01F 1/0577 335/302 |
| 2013/0154424 | A1 * | 6/2013 | Nakajima | C22C 38/16 419/38 |
| 2014/0132377 | A1 * | 5/2014 | Nakajima | C22C 38/16 420/83 |
| 2014/0191831 | A1 * | 7/2014 | Yamazaki | H01F 1/0577 335/302 |
| 2014/0314612 | A1 * | 10/2014 | Nakajima | H01F 1/0577 419/38 |
| 2016/0189837 | A1 | 6/2016 | Ishii et al. | |
| 2016/0284452 | A1 * | 9/2016 | Horikita | H01F 1/0577 |
| 2017/0162305 | A1 * | 6/2017 | Yamazaki | C22C 38/002 |

FOREIGN PATENT DOCUMENTS

| | | | |
|---|---|---|---|
| CN | 1249845 | A | 4/2000 |
| CN | 1723511 | A | 1/2006 |
| CN | 102067249 | A | 5/2011 |
| CN | 103582715 | A | 2/2014 |
| CN | 103915232 | A | 7/2014 |
| CN | 104112581 | A | 10/2014 |
| JP | 2006-210893 | A | 8/2006 |
| JP | 2006203216 | A * | 8/2006 |
| JP | 2013-216965 | A | 10/2013 |
| JP | 2014-27268 | A | 2/2014 |
| JP | 2016-115777 | A | 6/2016 |
| WO | 2008/139556 | A1 | 11/2008 |
| WO | 2008/139559 | A1 | 11/2008 |
| WO | 2015/022946 | A1 | 2/2015 |

OTHER PUBLICATIONS

English Abstract of JP 2006/203216, dated Aug. 2006; 2 pages.*

Communication dated Jul. 10, 2017 from the State Intellectual Property Office of the P.R.C. in counterpart Application No. 201610134238.2.

Masato Sagawa, "Permanent Magnet-Material Science Application", First Edition Second Impression published on Nov. 30, 2008, pp. 256-261.

Communication dated Feb. 7, 2018 from the State Intellectual Property Office of the P.R.C. in counterpart application No. 201610134238.2.

Communication dated Jul. 23, 2018 from the State Intellectual Property Office of the P.R.C. in corresponding Chinese Application No. 201610134238.2.

* cited by examiner

*Primary Examiner* — Helene Klemanski
(74) *Attorney, Agent, or Firm* — Sughrue Mion, PLLC

(57) ABSTRACT

An R-T-B-based rare earth sintered magnet, comprising a rare earth element R, B, a metallic element M which includes one or more metals selected from Al, Ga and Cu, a transition metal T which includes Fe as a main component, and inevitable impurities, wherein the sintered magnet includes 13 atom % to 15.5 atom % of R, 5.0 atom % to 6.0 atom % of B, 0.1 atom % to 2.4 atom % of M, and T and the inevitable impurities as a balance, and wherein the sintered magnet includes 0.015 atom % to 0.10 atom % of Zr as the transition metal T.

10 Claims, 4 Drawing Sheets

R-T-B-BASED RARE EARTH SINTERED MAGNET AND ALLOY FOR R-T-B-BASED RARE EARTH SINTERED MAGNET

BACKGROUND OF THE INVENTION

1. Field of the Invention

The present invention relates to an R-T-B-based rare earth sintered magnet and an alloy for an R-T-B-based rare earth sintered magnet.

Priority is claimed on Japanese Patent Application No. 2015-051353, filed on Mar. 13, 2015 and Japanese Patent Application No. 2015-236922, filed on Dec. 3, 2015 the content of which is incorporated herein by reference.

2. Description of Related Art

In the related art, an R-T-B-based rare earth sintered magnet (hereinafter, in some cases, abbreviated as the "R-T-B-based magnet") was used in motors such as a voice coil motor in a hard disc drive and engine motors for hybrid vehicles or electrical vehicles.

An R-T-B-based magnet is obtained by shaping and sintering R-T-B-based alloy powder including Nd, Fe, and B as main components. Generally, in the R-T-B-based alloy, R represents Nd or Nd, some of which is substituted with other rare earth elements such as Pr, Dy, and Tb. T represents Fe or Fe, some of which is substituted with other transition metals such as Co and Ni. B represents boron, some of which can be substituted with C or N.

The structure of an ordinary R-T-B-based magnet is made up of, mainly, the main phase and an R-rich phase. The main phase is constituted with $R_2T_{14}B$. The R-rich phase is present in a grain boundary of the main phase and has a higher concentration of Nd than the main phase. The R-rich phase is also referred to as a grain boundary phase.

The composition of the R-T-B-based alloy is generally set so that, in order to increase the proportion of the main phase in the structure of the R-T-B-based magnet, the ratio between Nd, Fe, and B approximates to that of $R_2T_{14}B$ as much as possible (for example, refer to Masato Sagawa, Permanent Magnet—Material Science and Application, second impression of the first edition published on Nov. 30, 2008, pp. 256 to 261).

In addition, an R-T-B-based magnet used in a motor for vehicles is exposed to a high temperature in the motor, and thus a high coercive force (Hcj) is required.

As a technique for improving the coercive force of an R-T-B-based magnet, there is a technique in which the R in the R-T-B-based alloy is substituted from Nd to Dy. However, Dy is an eccentrically located resource and has a limited production, and thus the supply of Dy is unstable. Therefore, studies are underway regarding a technique for improving the coercive force of the R-T-B-based magnet without increasing the amount of Dy in the R-T-B-based alloy.

The present inventors studied the composition of the R-T-B-based alloy and, consequently, found that the coercive force improves when the concentration of a specific B is lower than that in the R-T-B-based alloy in the related art. In addition, the present inventors successfully developed an R-T-B-based alloy with which an R-T-B-based magnet having a high coercive force can be obtained even when the amount of Dy is zero or extremely low (for example, refer to Japanese Unexamined Patent Application, First Publication No. 2013-216965).

An R-T-B-based magnet manufactured using the R-T-B-based alloy developed by the present inventors includes a main phase made of $R_2T_{14}B$ and a grain boundary phase including a larger amount of R than the main phase. In the R-T-B-based magnet, as the grain boundary phase, a grain boundary phase (transition metal-rich phase) having a lower concentration of rare earth elements and a higher concentration of transition metal elements than the grain boundary phase of the related art is included as well as a grain boundary phase (R-rich phase) having a high concentration of rare earth elements, which is known in the related art. The transition metal-rich phase is a phase capable of imparting a coercive force, and an R-T-B-based magnet in which the transition metal-rich phase is present in the grain boundary phase is a revolutionary technique that renders obsolete the conventional wisdom of the related art.

SUMMARY OF THE INVENTION

The R-T-B-based magnet developed by the present inventors exhibits a high coercive force (Hcj) in spite of a suppressed amount of Dy; however, there is a demand for an additional increase in the coercive force.

The present invention has been made in consideration of the above-described circumstances, and an object of the present invention is to provide an R-T-B-based rare earth sintered magnet and an alloy for an R-T-B-based rare earth sintered magnet which have a higher coercive force (Hcj) obtained by further improving the R-T-B-based rare earth sintered magnet and the alloy for an R-T-B-based rare earth sintered magnet developed by the present inventors.

The present invention employed the following means in order to achieve the above-described object.

(1) According to an aspect of the present invention there is provided an R-T-B-based rare earth sintered magnet, comprising a rare earth element R, B, a metallic element M which includes one or more metals selected from Al, Ga and Cu, a transition metal T which includes Fe as a main component, and inevitable impurities, wherein the sintered magnet includes 13 atom % to 15.5 atom % of R, 5.0 atom % to 6.0 atom % of B, 0.1 atom % to 2.4 atom % of M, and T and the inevitable impurities as a balance, and wherein the sintered magnet includes 0.015 atom % to 0.10 atom % of Zr as the transition metal T.

(2) In the aspect stated in the above (1), the R-T-B-based rare earth sintered magnet, in which, in a grain boundary phase, the Zr may not form a compound with B.

(3) In the aspect stated in the above (1) or (2), the R-T-B-based rare earth sintered magnet, may satisfy the following formula (1):

$$0.32 \leq B/TRE \leq 0.40 \quad (1)$$

wherein, in the formula (1), B represents a concentration (atom %) of a boron element and TRE represents a concentration (atom %) of total rare earth elements.

(4) According to an aspect of the present invention there is provided an alloy for an R-T-B-based rare earth sintered magnet, comprising: a rare earth element R, B, a metallic element M which includes one or more metals selected from Al, Ga and Cu, a transition metal T which includes Fe as a main component, and inevitable impurities, wherein the sintered magnet includes 13 atom % to 15.5 atom % of R, 5.0 atom % to 6.0 atom % of B, 0.1 atom % to 2.4 atom % of M, and T and the inevitable impurities as a balance, and wherein the sintered magnet includes 0.015 atom % to 0.10 atom % of Zr as the transition metal T.

(5) In the aspect stated in the above (4), the alloy for an R-T-B-based rare earth sintered magnet, may satisfy the following formula (1):

$$0.32 \leq B/TRE \leq 0.40 \quad (1)$$

wherein, in the formula (1), B represents a concentration (atom %) of a boron element and TRE represents a concentration (atom %) of total rare earth elements.

According to the R-T-B-based rare earth sintered magnet and the alloy for an R-T-B-based rare earth sintered magnet of the present invention, it is possible to provide an R-T-B-based rare earth sintered magnet and an alloy for an R-T-B-based rare earth sintered magnet which have a higher coercive force in spite of a suppressed amount of Dy.

DETAILED DESCRIPTION OF THE INVENTION

Figure 1:
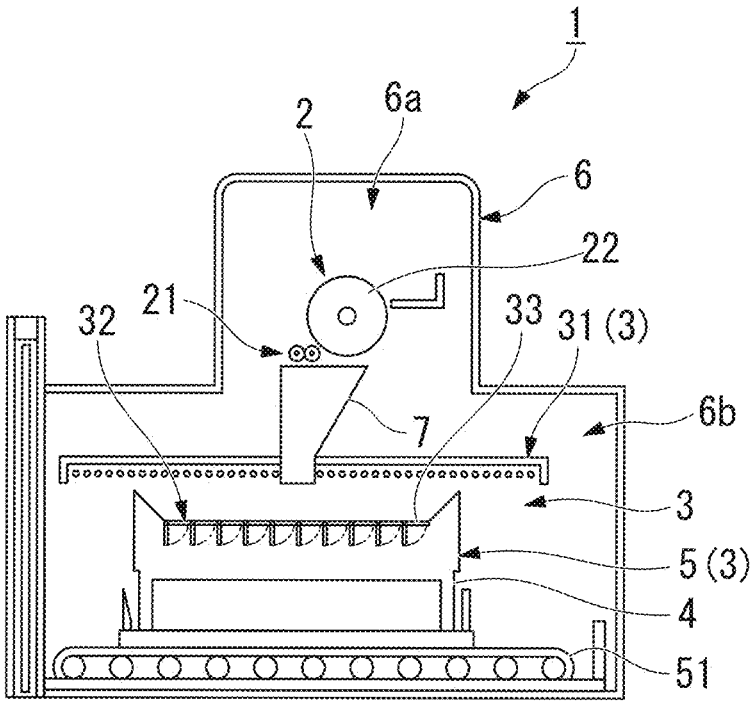
FIG. 1 is a schematic front view illustrating an example of an apparatus for manufacturing an alloy.

Hereinafter, an R-T-B-based rare earth sintered magnet of an embodiment of the present invention will be described in detail. The present invention is not limited to the embodiment described below and can be carried out in an appropriately modified form within the scope of the spirit of the present invention. The R-T-B-based rare earth sintered magnet of the present invention may include other elements within the scope of the object of the present invention.

"R-T-B-Based Rare Earth Sintered Magnet"

An R-T-B-based rare earth sintered magnet of the present embodiment (hereinafter, in some cases, abbreviated as the "R-T-B-based magnet") includes a rare earth element R, a transition metal T including Fe as a main component, a metallic element M including one or more metals selected from Al, Ga, and Cu, B, and inevitable impurities. The R-T-B-based magnet of the present embodiment includes 13 atom % to 15.5 atom % of R, 5.0 atom % to 6.0 atom % of B, 0.1 atom % to 2.4 atom % of M, and T and the inevitable impurities as a balance, and 0.015 atom % to 0.10 atom % of Zr is included as the transition metal T.

When the amount of R in the R-T-B-based magnet is less than 13 atom %, the coercive force of the R-T-B-based magnet becomes insufficient. In addition, when the amount of R exceeds 15.5 atom %, the degree of remanence in the R-T-B-based magnet becomes low.

The R-T-B-based magnet of the present embodiment may or may not include Dy. Examples of rare earth elements other than Dy which can be included in the R-T-B-based magnet include Sc, Y, La, Ce, Pr, Nd, Pm, Sm, Eu, Gd, Tb, Ho, Er, Tm, Yb, and Lu. Among these rare earth elements, particularly, Nd, Pr, Dy, and Tb are preferably used. In addition, R in the R-T-B-based magnet preferably includes Nd as a main component.

The metallic element M in the R-T-B-based magnet is one or more metals selected from Al, Ga, and Cu. One or more metals selected from Al, Ga, and Cu which are included in the metallic element M accelerate the generation of a transition metal-rich phase when manufacturing the R-T-B-based magnet. As a result, the coercive force (Hcj) of the R-T-B-based magnet is effectively improved.

In the R-T-B-based magnet, 0.1 atom % to 2.4 atom % of the metallic element M is included. Therefore, when manufacturing the R-T-B-based magnet, the generation of a transition metal-rich phase is accelerated. When the amount of the metallic element M in the R-T-B-based magnet is less than 0.1 atom %, the effect of accelerating the generation of a transition metal-rich phase is insufficient. As a result, a transition metal-rich phase is not formed in the R-T-B-based magnet, an $R_2T_{17}$ phase is precipitated, and there is a concern that the coercive force (Hcj) of the R-T-B-based magnet may become insufficient. In order to sufficiently generate a transition metal-rich phase, the amount of the metallic element M in the R-T-B-based magnet is preferably 0.7 atom % or higher. In addition, when the amount of the metallic element M in the R-T-B-based magnet exceeds 2.4 atom %, the magnetic properties such as the remanence (Br) or the maximum energy product (BHmax) of the R-T-B-based magnet degrade. In order to ensure the remanence and the maximum energy product of the R-T-B-based magnet, the amount of the metallic element M in the R-T-B-based magnet is preferably 2.4 atom % or less.

In a case in which the metallic element M includes Cu, sintering for manufacturing the R-T-B-based magnet becomes easy, which is preferable. In a case in which the metallic element M includes Cu, when the concentration of Cu in the R-T-B-based magnet is less than 1.0 atom %, remanence (Br) in the R-T-B-based magnet becomes favorable.

B in the R-T-B-based magnet is boron and can be partially substituted with C or N. The amount of B is in a range of 5.0 atom % to 6.0 atom %. Furthermore, the R-T-B-based magnet of the present embodiment preferably satisfies the following formula (1). In the present embodiment, when the amount of B is in the above-described range and, preferably, B/TRE is in a range represented by the formula (1), the R-T-B-based magnet has a high coercive force. The reason therefor is assumed as described below.

$$0.32 \leq B/TRE \leq 0.40 \quad (1)$$

Wherein, in the formula (1), B represents a concentration (atom %) of a boron element and TRE represents a concentration (atom %) of total rare earth elements.

When the amount of B is in the above-described range and, preferably, B/TRE is in the above-described range, the amount of a transition metal and a rare earth element in the R-T-B-based magnet becomes relatively large. As a result, in a process for manufacturing the R-T-B-based magnet, the generation of a transition metal-rich phase is effectively accelerated due to the metallic element M. Therefore, the R-T-B-based magnet has a high coercive force due to the generation of a sufficient amount of a transition metal-rich phase.

In addition, when the amount of B in the R-T-B-based magnet exceeds 6.0 atom %, a B-rich phase becomes included in the R-T-B-based magnet, and the coercive force becomes insufficient. Therefore, the amount of B in the R-T-B-based magnet is set to 6.0 atom % or less and preferably set to 5.5 atom % or less.

In addition, B/TRE represented by the formula (1) is in a range of 0.32 to 0.40 and is more preferably set in a range of 0.34 to 0.38 in order to provide a high coercive force to the R-T-B-based magnet.

The transition metal T in the R-T-B-based magnet includes Fe as a main component and further includes Zr in a range of 0.015 atom % to 0.10 atom %. The lower limit of the amount of Zr is preferably 0.017 atom % and more preferably 0.018 atom %. The upper limit of the amount of Zr is preferably 0.04 atom %, more preferably 0.03 atom %, and still more preferably 0.02 atom %.

When the amount of Zr is set in the above-described range, it is possible to produce an R-T-B-based magnet having a high coercive force while maintaining squareness (Hk/Hcj) at a high level.

Zr is known to exhibit an effect of suppressing the grain growth of a main phase during sintering for manufacturing the R-T-B-based magnet.

The present inventors carried out intensive studies and, consequently, found that, in a case in which the amount of Zr is in the above-described range, it is possible to improve the coercive force while maintaining high squareness. That is, it was found that, when the amount of Zr is decreased to the minimum amount at which the grain growth of the main phase is prevented, in the above-described extremely narrow range, the coercive force improves while maintaining high squareness.

The mechanism for the coercive force being increased in a case in which the amount of Zr is in the above-described range is assumed as described below.

Zr is present in two forms in the R-T-B-based magnet. The first form is Zr substituting Fe sites in the main phase, and the second form is Zr present in a grain boundary phase as a boride. When Zr substitutes Fe sites in the main phase, grain growth is suppressed in a sintering process, and thus the coercive force of the R-T-B-based magnet improves. In addition, a boride is generated due to a reaction between Zr and B in the grain boundary phase, but does not have any influences on magnetic properties.

In a process for manufacturing the R-T-B-based magnet, the substitution of Fe sites with Zr and the generation of a boride are considered to proceed at the same time. In the present embodiment, since the amount of B is less than that in an ordinary R-T-B-based magnet, B is rarely present in the grain boundary phase. Therefore, Fe sites are preferentially substituted with Zr. In a case in which the amount of Zr is in the above-described range, Fe sites are substituted with Zr, and grain growth in a sintering process is suppressed.

When the amount of Zr is higher than the upper limit value of the above-described range, Zr reacts with B in the main phase and generates a boride in the grain boundary phase. Since the reaction decomposes the main phase, both the remanence and the coercive force of the R-T-B-based magnet decrease.

In addition, when the amount of Zr becomes less than the lower limit value of the above-described range, it is not possible to suppress grain growth in the main phase during sintering and, consequently, the coercive force becomes low.

Since the coercive force decreases when the amount of Zr is outside the above-described range, consequently, it is considered that the coercive force becomes high when the amount of Zr is in the above-described narrow range.

In the R-T-B-based magnet of the present embodiment, since the amount of B is less than that in the related art, B is rarely included in the grain boundary phase. Therefore, a majority of Zr is used to substitute Fe sites and little or no Zr reacts with B in the grain boundary phase. Therefore, it is considered that, with a lower amount of Zr than that in the R-T-B-based magnet of the related art, an effect of improving the coercive force can be obtained while maintaining high squareness.

In the present specification, the expression "Zr does not form a compound with B" means that Zr does not generate a compound with B or only a small amount of Zr with which bright spots corresponding to the compound are not observed in an observation image of a field-emission electron probe micro analyzer (FE-EPMA) forms a compound with B. More specifically, the expression means that, in Japanese Unexamined Patent Application, First Publication No. 2014-27268, bright spots corresponding to bright spots corresponding to a compound constituting a phase including Zr, B, and C are not observed.

As transition metals other than Fe and Zr in T of the R-T-B-based magnet, it is possible to use a variety of elements belonging to Groups 3 to 11. Specific examples thereof include Co, Nb, and the like. In a case in which T of the R-T-B-based magnet includes Co as well as Fe, Tc (the Curie temperature) and corrosion resistance can be improved, which is preferable. In addition, as described above, in a case in which T of the R-T-B-based magnet includes Nb as well as Fe, grain growth in the main phase during sintering for manufacturing the R-T-B-based magnet is suppressed, which is preferable.

The ratio (T/B) of the amount of T to the amount of B which are included in the R-T-B-based magnet is preferably in a range of 13 to 15.5. When the T/B of the R-T-B-based magnet is in the above-described range, the coercive force of the R-T-B-based magnet becomes higher. In addition, when the T/B of the R-T-B-based magnet is in a range of 13 to 15.5, in the process for manufacturing the R-T-B-based magnet, the generation of the transition metal-rich phase is more effectively accelerated. When the T/B of the R-T-B-based magnet is 15.5 or lower and more preferably 15 or lower, a $R_2T_{17}$ phase is not easily generated in the R-T-B-based magnet while being manufactured, and a favorable coercive force and favorable squareness can be obtained. In addition, when the T/B of the R-T-B-based magnet is 13 or higher and more preferably 13.5 or higher, remanence in the R-T-B-based magnet becomes favorable.

The R-T-B-based magnet of the present embodiment includes a main phase made of $R_2T_{14}B$ and a grain boundary phase including a larger amount of R than the main phase. The grain boundary phase includes an R-rich phase and a transition metal-rich phase having a lower concentration of R and a higher concentration of transition metal elements than the R-rich phase. In the R-rich phase, the total atomic concentration of rare earth elements is 50 atom % or higher. In the transition metal-rich phase, the total atomic concentration of rare earth elements is in a range of 25 atom % to 35 atom %.

The area ratio of the transition metal-rich phase in the R-T-B-based magnet is more preferably in a range of 0.005% by area to 3% by area. When the area ratio of the transition metal-rich phase is in the above-described range, the coercive force improvement effect of the transition metal-rich phase in the grain boundary phase can be more effectively obtained. In contrast, when the area ratio of the transition metal-rich phase is less than 0.005% by area, an $R_2T_{17}$ phase is precipitated, and there is a concern that the effect of improving the coercive force (Hcj) may become insufficient. In addition, when the area ratio of the transition metal-rich phase exceeds 3% by area, there is a concern that magnetic properties may be adversely affected so that remanence (Br) or the maximum energy product (BHmax) degrades, which is not preferable.

The area ratio of the transition metal-rich phase in the R-T-B-based magnet is investigated using a method described below. First, the R-T-B-based magnet is implanted in a conductive resin, and a surface parallel to an orientation direction is cut out and mirror-polished. Next, the mirror-polished surface is observed using a backscattered electron image at a magnification of approximately 1500 times, and the main phase, the R-rich phase, and the transition metal-rich phase are differentiated on the basis of contrast. After that, the area ratio of the transition metal-rich phase per cross-section is computed.

The area ratio of the transition metal-rich phase can be easily adjusted by adjusting the composition of an alloy for a magnet (or an alloy for a magnet and an alloy for reforming) which is used as a raw material or by adjusting the conditions of at least any heat treatment of a sintering process, a first heat treatment process, and a second heat treatment process described below.

The atomic concentration of Fe in the transition metal-rich phase is preferably in a range of 50 atom % to 70 atom %. When the atomic concentration of Fe in the transition metal-rich phase is in the above-described range, the coercive force improvement effect of the transition metal-rich phase becomes more significant.

"Method of Manufacturing R-T-B-Based Rare Earth Sintered Magnet"

A method of manufacturing an R-T-B-based rare earth sintered magnet of the present invention will be described below.

"Process for Manufacturing Alloy"

As an alloy for the R-T-B-based rare earth sintered magnet of the present invention, a cast alloy thin piece can be manufactured by, for example, casting a molten alloy having a temperature of approximately 1450° C. and a predetermined composition using a strip casting (SC) method. At this time, a treatment for accelerating the diffusion of components in the alloy by temporarily decreasing the cooling rate of the cast alloy thin piece after the casting in a temperature range of 700° C. to 900° C. (temperature-holding process) may be carried out.

After that, the obtained cast alloy thin piece is decrepitated using a hydrogen decrepitation method or the like and is ground using a grinder, thereby obtaining an R-T-B-based alloy.

The alloy for an R-T-B-based rare earth sintered magnet includes a rare earth element R, a transition metal T including Fe as a main component, a metallic element M including one or more metals selected from Al, Ga, and Cu, B, and inevitable impurities. The alloy for a magnet includes 13 atom % to 15.5 atom % of R, 5.0 atom % to 6.0 atom % of B, 0.1 atom % to 2.4 atom % of M, and T and the inevitable impurities as a balance, and 0.015 atom % to 0.10 atom % of Zr is included as the transition metal T. The alloy for an R-T-B-based rare earth sintered magnet does not need to include Dy but may include Dy in order to obtain a predetermined coercive force.

Furthermore, the alloy for an R-T-B-based rare earth sintered magnet preferably satisfies the following formula (1).

$$0.32 \leq B/TRE \leq 0.40 \quad (1)$$

Wherein, in the formula (1), B represents a concentration (atom %) of a boron element and TRE represents a concentration (atom %) of total rare earth elements.

When the amount of R in the alloy for an R-T-B-based rare earth sintered magnet is less than 13 atom %, the coercive force of the R-T-B-based magnet obtained using this alloy becomes insufficient. In addition, when the amount of R exceeds 15.5 atom %, the degree of remanence in the R-T-B-based magnet becomes low.

Examples of rare earth elements included in the alloy for an R-T-B-based rare earth sintered magnet include Sc, Y, La, Ce, Pr, Nd, Pm, Sm, Eu, Gd, Dy, Tb, Ho, Er, Tm, Yb, and Lu. Among these rare earth elements, particularly, Nd, Pr, Dy, and Th are preferably used. In addition, R in the alloy for a magnet preferably includes Nd as a main component.

The metallic element M in the alloy for an R-T-B-based rare earth sintered magnet is one or more metals selected from Al, Ga, and Cu. One or more metals selected from Al, Ga, and Cu which are included in the metallic element M accelerate the generation of a transition metal-rich phase when manufacturing the R-T-B-based magnet. As a result, the coercive force (Hcj) of the R-T-B-based magnet is effectively improved.

In the alloy for an R-T-B-based rare earth sintered magnet, 0.1 atom % to 2.4 atom % of the metallic element M is included. Therefore, the R-T-B-based magnet including the R-rich phase and the transition metal-rich phase is obtained by sintering and heat treating the alloy for a magnet. When the amount of the metallic element M in the alloy for a magnet is less than 0.1 atom %, the effect of accelerating the generation of a transition metal-rich phase is insufficient. As a result, a transition metal-rich phase is not formed in the R-T-B-based magnet, and there is a concern that the coercive force (Hcj) of the R-T-B-based magnet may become insufficient. In order to sufficiently generate a transition metal-rich phase, the amount of the metallic element M in the alloy for a magnet is preferably 0.7 atom % or higher. In addition, when the amount of the metallic element M in the alloy for a magnet exceeds 2.4 atom %, the magnetic properties such as the remanence (Br) or the maximum energy product (BHmax) of the R-T-B-based magnet degrade. In order to ensure the remanence and the maximum energy product of the R-T-B-based magnet, the amount of the metallic element M in the alloy for a magnet is preferably 2.4 atom % or less.

In a case in which the metallic element M includes Ga, Ga has a strong effect of suppressing the generation of a $R_2T_{17}$ phase, and thus it is possible to prevent the coercive force or squareness from being decreased due to the generation of the $R_2T_{17}$ phase. Therefore, the metallic element M preferably includes Ga.

In a case in which the metallic element M includes Cu, sintering of the alloy for a magnet becomes easy, which is preferable. In a case in which the metallic element M includes Cu, when the concentration of Cu in the alloy for a magnet is less than 1.0 atom %, remanence (Br) in the R-T-B-based magnet manufactured using the alloy for a magnet becomes favorable.

B in the alloy for an R-T-B-based rare earth sintered magnet is boron and can be partially substituted with C or N. The amount of B is in a range of 5.0 atom % to 6.0 atom %, and B/TRE, which is the ratio of the concentration of B to the concentration of the rare earth element, preferably satisfies the formula (1). Therefore, in the present embodiment, an R-T-B-based magnet manufactured using the alloy for a magnet has a high coercive force. The reason therefor is assumed as described below.

When the amount of B and B/TRE of the alloy for an R-T-B-based rare earth sintered magnet are in the above-described ranges, in an R-T-B-based magnet manufactured using the alloy for a magnet, grain boundary phases are uniformly dispersed, and a high coercive force is obtained. Furthermore, when the amount of B and B/TRE of the alloy for a magnet are in the above-described ranges, the amount of the transition metal and the rare earth element in the alloy for a magnet becomes relatively large. As a result, in a process for manufacturing the R-T-B-based magnet, the generation of a transition metal-rich phase is effectively accelerated. Therefore, the R-T-B-based magnet manufactured using the alloy for a magnet has a high coercive force due to the generation of a sufficient amount of a transition metal-rich phase.

When the amount of B in the alloy for an R-T-B-based rare earth sintered magnet is less than 5.0 atom %, there are cases in which a $R_2T_{17}$ phase is precipitated in the R-T-B magnet and the coercive force is not sufficient. When the amount of B in the alloy for a magnet exceeds 6.0 atom %, a B-rich phase becomes included in the R-T-B-based magnet manufactured using this alloy, and the coercive force becomes insufficient. Therefore, the amount of B in the alloy for a magnet is set to 6.0 atom % or less and preferably set to 5.5 atom % or less.

The transition metal T in the alloy for an R-T-B-based rare earth sintered magnet includes Fe as a main component and further includes Zr in a range of 0.015 atom % to 0.10 atom %. The lower limit of the amount of Zr is preferably 0.017 atom % and more preferably 0.018 atom %. The upper limit of the amount of Zr is preferably 0.04 atom %, more preferably 0.03 atom %, and still more preferably 0.02 atom %.

When the amount of Zr is set in the above-described range, it is possible to produce an R-T-B-based magnet having a high coercive force while maintaining squareness (Hk/Hcj) at a high level.

The ratio (T/B) of the amount of T to the amount of B which are included in the alloy for an R-T-B-based rare earth sintered magnet is preferably in a range of 13 to 15.5. When the T/B of the alloy for a magnet is in the above-described range, the coercive force of the R-T-B-based magnet manufactured using the alloy for a magnet becomes higher. In addition, when the T/B of the alloy for a magnet is in a range of 13 to 15.5, in the process for manufacturing the R-T-B-based magnet, the generation of the transition metal-rich phase is more effectively accelerated. When the T/B of the alloy for a magnet is 15.5 or less and more preferably 15 or less, the generation of a $R_2T_{17}$ phase in the R-T-B-based magnet manufactured using the alloy for a magnet is prevented, and it is possible to prevent a decrease in the coercive force or squareness. In addition, when T/B in the alloy for a magnet is 13 or higher and more preferably 13.5 or higher, remanence in the R-T-B-based magnet manufactured using the alloy for a magnet becomes favorable.

When the total concentration of oxygen, nitrogen, and carbon included as impurities and the like in the alloy for an R-T-B-based rare earth sintered magnet is high, in the sintering process, these elements and the rare earth element R bond to each other, and thus the rare earth element R is consumed. Therefore, out of the rare earth element R in the alloy for a magnet, in the first heat treatment process and the second heat treatment process carried out after the sintering process, the amount of the rare earth element R used as a raw material for the transition metal-rich phase decreases. As a result, the amount of the transition metal-rich phase generated becomes low, and there is a concern that the coercive force of the R-T-B-based magnet may become insufficient.

Therefore, the total concentration of oxygen, nitrogen, and carbon included in the alloy for an R-T-B-based rare earth sintered magnet is preferably 2 atom % or less. When the total concentration of oxygen, nitrogen, and carbon included in the alloy for an R-T-B-based rare earth sintered magnet is set to 2 atom % or less, it is possible to suppress the rare earth element R being consumed in the sintering process and to ensure the amount of the transition metal-rich phase generated. Therefore, an R-T-B-based magnet having a high coercive force (Hcj) is obtained.

The alloy for an R-T-B-based rare earth sintered magnet includes a main phase made of $R_2T_{14}B$ and a grain boundary phase including a larger amount of R than the main phase.

As an example of a process for manufacturing the alloy for an R-T-B-based rare earth sintered magnet of the present invention, a manufacturing method in which a manufacturing apparatus illustrated in FIG. 1 is used will be described.

(Apparatus for Manufacturing Alloy)

FIG. 1 is a schematic front view illustrating an example of an apparatus for manufacturing an alloy.

An apparatus for manufacturing an alloy 1 illustrated in FIG. 1 includes a casting device 2, a crushing device 21, a heating device 3 disposed below the crushing device 21, and a storage container 4 disposed below the heating device 3.

The crushing device 21 is a device that crushes a cast alloy ingot cast using the casting device 2 so as to produce cast alloy thin pieces. As illustrated in FIG. 1, a hopper 7 that guides the cast alloy thin pieces onto an openable stage group 32 of the heating device 3 is provided between the crushing device 21 and the openable stage group 32.

The heating device 3 is constituted with a heating heater 31 and a container 5. The container 5 includes a storage container 4 and the openable stage group 32 installed in the upper portion of the storage container 4. The openable stage group 32 is made up of a plurality of openable stages 33. The openable stages 33 hold the cast alloy thin pieces supplied from the crushing device 21 when "closed" and send the cast alloy thin pieces to the storage container 4 when "opened".

In addition, the manufacturing apparatus 1 includes a belt conveyer 51 (moving device) that makes the container 5 movable, and the belt conveyer 51 enables the container 5 to move in the right and left direction in FIG. 1.

In addition, the manufacturing apparatus 1 illustrated in FIG. 1 includes a chamber 6. The chamber 6 includes a casting chamber **6*a* and a heat retention and storage chamber 6*b* which is installed below the casting chamber 6*a* and communicates with the casting chamber 6. The casting device 2 is housed in the casting chamber 6*a*, and the heating device 3 is housed in the heat retention and storage chamber 6*b***.

In the present embodiment, in order to manufacture the alloy for an R-T-B-based rare earth sintered magnet, first, a molten alloy having a temperature of approximately 1450° C. and a predetermined composition is prepared in a melting device (not illustrated). Next, the obtained molten alloy is supplied to a cooling roll 22 made of a water cooling copper roll in the casting device 2 using a tundish (not illustrated) and is solidified, thereby producing a cast alloy. After that, the cast alloy is detached from the cooling roll 22 and is made to pass through crushing rolls in the crushing device 21 so as to be crushed, thereby producing cast alloy thin pieces.

The crushed cast alloy thin pieces are made to pass through the hopper 7 and are piled up on the openable stages 33 causing the openable stage group 32 disposed below the hopper 7 to be in a "closed" state. The cast alloy thin pieces piled up on the openable stages 33 are heated using the heating heater 31.

In the present embodiment, while the temperature of the manufactured cast alloy is decreased from higher than 800°

C. to lower than 500° C., a temperature-holding process of maintaining the cast alloy at a constant temperature for 10 seconds to 120 seconds is carried out. In the present embodiment, the cast alloy thin pieces having a temperature in a range of 800° C. to 500° C. are supplied onto the openable stages 33 and begin to be heated using the heating heater 31 immediately after the cast alloy thin pieces are piled up on the openable stages 33. In the above-described manner, a temperature-holding process of maintaining the cast alloy at a constant temperature for 10 seconds to 120 seconds is initiated.

In addition, after a predetermined period of time elapses, the openable stages 33 fall into an "open" state and the cast alloy thin pieces piled up on the openable stages 33 are dropped to the storage container 4. Therefore, heat from the heating heater 31 does not reach the cast alloy thin pieces, the cooling of the cast alloy thin pieces is initiated again, and the temperature-holding process ends.

In a case in which the temperature-holding process is carried out, it is assumed that, among elements in the cast alloy, due to the redisposition of elements migrating in the cast alloy, the component interchange between the metallic element M including one or more metals selected from Al, Ga, and Cu and B is accelerated; therefore, a portion of B in a region serving as an alloy grain boundary phase migrates toward the main phase, and a portion of the metallic element M in a region serving as the main phase migrates toward the alloy grain boundary phase; consequently, the intrinsic magnetic properties of the main phase can be exhibited, and thus the coercive force of an R-T-B-based magnet for which the cast alloy is used becomes high.

In a case in which the temperature of the cast alloy in the temperature-holding process is higher than 800° C., there is a concern that the alloy structure may coarsen. In addition, in a case in which the temperature-holding duration exceeds 120 seconds, there are cases in which the productivity is adversely affected.

In addition, in a case in which the temperature of the cast alloy in the temperature-holding process is lower than 500° C. or the temperature-holding duration is shorter than 10 seconds, there are cases in which the effect of the redisposition of the element occurring in the temperature-holding process is not sufficiently obtained.

Meanwhile, in the present invention, the temperature-holding process is carried out using a method in which the cast alloy thin pieces piled up on the openable stages 33 are heated using the heating heater 31 in a temperature range of 800° C. to 500° C., but there are no limitations regarding the method of the temperature-holding process as long as the cast alloy having a temperature exceeding 800° C. can be maintained at a certain temperature for 10 seconds to 120 seconds until the temperature of the cast alloy reaches lower than 500° C.

In addition, in the method of manufacturing the alloy for an R-T-B-based rare earth sintered magnet of the present embodiment, the inside of the chamber 6 for manufacturing the R-T-B-based alloy is preferably set to a reduced-pressure atmosphere of an inert gas. Furthermore, in the present embodiment, at least a portion of a casting process is preferably carried out in an atmosphere including helium. Compared with argon, helium has a better capability of dissipating heat from the cast alloy and is capable of more easily increasing the cooling rate of the cast alloy.

Examples of a method of carrying out at least a portion of the casting process in an atmosphere including helium include a method in which helium is supplied as an inert gas into the casting chamber **6*a* in the chamber 6 at a predetermined flow rate. In this case, an atmosphere including helium is formed in the casting chamber 6*a*, and thus it is possible to efficiently cool the surface, which is not in contact with the cooling roll 22, of the cast alloy which is cast using the casting device 2 and quenched using the cooling roll 22. Therefore, the cooling rate of the cast alloy increases, the grain diameter in the alloy structure decreases, the cast alloy obtains excellent crushing properties, a fine alloy structure in which the gap between the alloy grain boundary phases is 3 μm or smaller is easily obtained, and the coercive force of an R-T-B-based magnet manufactured using this cast alloy can be improved. In addition, in a case in which an atmosphere including helium is formed in the casting chamber 6*a*, the cooling rate of the cast alloy increases, and thus the temperature of the cast alloy thin pieces piled up on the openable stages 33** can be easily set to 800° C. or lower.

In addition, in the method of manufacturing the R-T-B-based alloy of the present embodiment, the cast alloy thin pieces that have undergone the temperature-holding process are preferably cooled in an atmosphere including helium. In such a case, the cooling rate of the cast alloy thin pieces which are a cast alloy that has undergone the temperature-holding process increases, and thus the alloy structure becomes finer, the crushing properties are excellent, and a fine alloy structure in which the gap between the alloy grain boundary phases is 3 μm or smaller is easily obtained. Examples of a method of cooling the cast alloy thin pieces that have undergone the temperature-holding process in an atmosphere including helium include a method in which helium is supplied into the storage container 4 housing the cast alloy thin pieces dropped from the openable stages 33 at a predetermined flow rate.

Meanwhile, in the present embodiment, a case in which the alloy for an R-T-B-based rare earth sintered magnet is manufactured using the SC method has been described, but the alloy for an R-T-B-based rare earth sintered magnet used in the present invention is not limited to alloys manufactured using the SC method. For example, the alloy for an R-T-B-based rare earth sintered magnet may be manufactured using a centrifugal casting method, a book molding method, or the like.

The hydrogen decrepitation method is carried out in an order in which, for example, hydrogen is stored in the cast alloy thin pieces at room temperature, the cast alloy thin pieces are heat treated in hydrogen having a temperature of approximately 300° C., then, hydrogen present between lattices in the main phase is degassed by reducing the pressure, and then the cast alloy thin pieces are heat treated at a temperature of approximately 500° C., thereby removing hydrogen bonded to the rare earth elements in the grain boundary phases. In the hydrogen decrepitation method, the volume of the cast alloy thin pieces storing hydrogen expands, and thus a number of cracks are easily generated in the alloy, and the alloy is decrepitated.

In addition, as a method of crushing the hydrogen-decrepitated cast alloy thin pieces, jet milling or the like is used. The hydrogen-decrepitated cast alloy thin pieces are put into a jet mill and are finely crushed to an average grain size in a range of 1 μm to 4.5 μm using high-pressure nitrogen of, for example, 0.6 MPa, thereby producing powder. A small average grain size of the powder enables the improvement of the coercive force of a sintered magnet. However, when the grain size is too small, the powder surfaces are likely to be oxidized and, conversely, the coercive force decreases.

[Process for Manufacturing Magnet Using Alloy]

Next, a method of manufacturing an R-T-B-based magnet using the alloy for an R-T-B-based rare earth sintered magnet obtained in the above-described manner will be described.

Examples of a method of manufacturing the R-T-B-based magnet of the present embodiment include a method in which 0.02% by mass to 0.03% by mass of zinc stearate is added as a lubricant to the powder of the alloy for an R-T-B-based rare earth sintered magnet, the powder is pressed using a shaping machine in a transverse magnetic field, is sintered in a vacuum, and then is heat treated.

(Sintering Process)

In a case in which the powder is sintered at a temperature in a range of 800° C. to 1200° C. and more preferably in a range of 900° C. to 1200° C. and then is heat treated at a temperature in a range of 400° C. to 800° C., the transition metal-rich phase is more easily generated in the R-T-B-based magnet, and the R-T-B-based magnet having a higher coercive force is obtained.

In the present embodiment, when the formula (1) is satisfied, a $R_2T_{17}$ phase is generated in the R-T-B-based alloy. It is assumed that the $R_2T_{17}$ phase is used as a raw material for the transition metal-rich phase in the heat treatment after the production of the R-T-B-based magnet by sintering the R-T-B-based alloy.

The number of times of carrying out the heat treatment after the sintering may be one or more. For example, in a case in which the heat treatment is carried out only once after the sintering, the heat treatment is preferably carried out at a temperature in a range of 500° C. to 530° C., and, in a case in which the heat treatment is carried out twice after the sintering, the heat treatment is preferably carried out at two different temperatures of a temperature in a range of 600° C. to 950° C. and a temperature in a range of 400° C. to 500° C.

In a case in which the heat treatment is carried out at two different temperatures, it is assumed that the generation of the transition metal-rich phase is accelerated as described below, and thus an R-T-B-based magnet having higher coercive force is obtained.

That is, in a case in which the heat treatment is carried out at two different temperatures, in the first heat treatment at a temperature in a range of 600° C. to 950° C., the R-rich phase turns into a liquid phase and flows around the periphery of the main phase. Therefore, in the second heat treatment at a temperature in a range of 400° C. to 500° C., a reaction between the R-rich phase, the $R_2T_{17}$ phase, and the metallic element M is accelerated, and the generation of the transition metal-rich phase is accelerated.

In the method of manufacturing the R-T-B-based magnet of the present embodiment, as the R-T-B-based alloy, an alloy having the amount of B satisfying the formula (1) and including the metallic element M in a range of 0.1 atom % to 2.4 atom % is used, and thus a sintered body including a main phase including $R_2Fe_{14}B$ and a number of grain boundary phases including a larger amount of R than the main phase is produced, and the R-T-B-based magnet of the present invention in which the grain boundary phase includes an R-rich phase having a total atomic concentration of rare earth elements of 70 atom % or higher and a transition metal-rich phase having a total atomic concentration of rare earth elements in a range of 25 atom % to 35 atom % is obtained.

Furthermore, when the kind and used amount of metallic elements in the R-T-B-based alloy of the present embodiment, the area ratio of a region including a $R_2T_{17}$ phase, and the composition of the R-T-B-based alloy are adjusted to be in the ranges of the present invention, and the sintering temperature, the conditions for the heat treatment after the sintering and the like are adjusted, the area ratio of the transition metal-rich phase in the R-T-B-based magnet can be easily adjusted in a preferred range of 0.005% by area to 3% by area. In addition, when the area ratio of the transition metal-rich phase in the R-T-B-based magnet is adjusted, an R-T-B-based magnet having a predetermined coercive force suitable for an application can be obtained while suppressing the amount of Dy.

In addition, the effect of improving the coercive force (Hcj) obtained in the R-T-B-based magnet of the present invention is assumed to result from, firstly, the transition metal-rich phase including a high concentration of Fe formed in the grain boundary phase. The area ratio of the transition metal-rich phase in the R-T-B-based magnet of the present invention is preferably in a range of 0.005% by area to 3% by area and more preferably in a range of 0.1% by area to 2% by area.

When the area ratio of the transition metal-rich phase is in the above-described range, the coercive force-improving effect of the transition metal-rich phase included in the grain boundary phase is more effectively obtained. In contrast, when the area ratio of the transition metal-rich phase is less than 0.005% by area, there is a concern that the effect of improving the coercive force (Hcj) may become insufficient. In addition, when the area ratio of the transition metal-rich phase exceeds 3% by area, magnetic properties may be adversely affected so that remanence (Br) or the maximum energy product (BHmax) degrades, which is not preferable.

Furthermore, the effect of improving the coercive force (Hcj) obtained in the R-T-B-based magnet of the present invention is assumed to result from, secondly, the fact that the transition metal T in the R-T-B-based magnet includes Fe as a main component and, furthermore, includes 0.015 atom % to 0.10 atom % of Zr, and thus grain growth in the main phase during the sintering is suppressed, and the amount of a compound with boron (B) formed in the grain boundary phase is decreased.

The atomic concentration of Fe in the transition metal-rich phase is preferably in a range of 50 atom % to 70 atom %. When the atomic concentration of Fe in the transition metal-rich phase is in the above-described range, the effect of the inclusion of the transition metal-rich phase is more effectively obtained. In contrast, when the atomic concentration of Fe in the transition metal-rich phase is below the above-described range, there is a concern that the effect of improving the coercive force (Hcj) generated due to the inclusion of the transition metal-rich phase in the grain boundary phase may become insufficient. In addition, when the atomic concentration of Fe in the transition metal-rich phase is above the above-described range, there is a concern that a $R_2T_{17}$ phase or Fe may be precipitated and thus the magnetic properties may be adversely affected.

The R-T-B-based magnet of the present embodiment has a B/TRE amount satisfying the formula (1) and is produced by shaping and sintering an R-T-B-based alloy including 0.1 atom % to 2.4 atom % of the metallic element M. In addition, the grain boundary phase includes the R-rich phase and the transition metal-rich phase and has a lower total atomic concentration of rare earth elements and a higher atomic concentration of Fe in the transition metal-rich phase than that in the R-rich phase. As a result, the R-T-B-based magnet has a high coercive force and excellent magnetic properties which allow the R-T-B-based magnet to be preferably used for motors while suppressing the amount of Dy.

Meanwhile, in the present embodiment, the coercive force may be further improved by attaching a Dy metal or a Dy compound to the surface of the sintered R-T-B-based magnet, heat treating the magnet, and diffusing Dy in the sintered magnet, thereby producing an R-T-B-based magnet having a higher concentration of Dy on the surface of the sintered magnet than in the sintered magnet.

Specific examples of a method of manufacturing the R-T-B-based magnet having a higher concentration of Dy on the surface of the sintered magnet than in the sintered magnet include the following method. For example, the sintered R-T-B-based magnet is immersed in a coating liquid produced by mixing a solvent such as ethanol and dysprosium fluoride ($DyF_3$) at a predetermined ratio, thereby coating the R-T-B-based magnet with the coating liquid. After that, the R-T-B-based magnet coated with the coating liquid is subjected to a diffusion process in which a heat treatment is carried out in two separate stages. Specifically, the R-T-B-based magnet coated with the coating liquid is subjected to a first heat treatment in which the magnet is heated at a temperature of 900° C. for one hour in an argon atmosphere, and the R-T-B-base magnet which has undergone the first heat treatment is temporarily cooled to room temperature. After that, again, the R-T-B-based magnet is subjected to a second heat treatment in which the magnet is heated at a temperature of 500° C. for one hour in an argon atmosphere and is cooled to room temperature.

As a method of attaching a Dy metal or a Dy compound to the surface of the sintered R-T-B-based magnet other than the above-described method, a method in which a metal is gasified and a gaseous film is attached to the surface of the magnet, a method in which an organic metal is dissolved and a film is attached to the surface, or the like may be used.

Meanwhile, the sintered R-T-B-based magnet may be heat treated after a Tb metal or a Tb compound is attached to the surface of the magnet instead of a Dy metal or a Dy compound. In this case, for example, when the surface of the sintered R-T-B-based magnet is coated with a coating liquid including a Tb fluoride, the magnet is heat treated, and Tb is diffused in the sintered magnet, it is possible to produce an R-T-B-based magnet having a high concentration of Tb on the surface of the sintered magnet than in the sintered magnet, and the coercive force can be further improved.

In addition, the coercive force may be further improved by depositing metallic Dy or metallic Tb on the surface of the R-T-B-based magnet, heat treating the magnet, and diffusing Dy or Tb in the sintered magnet. For the R-T-B-based magnet of the present embodiment, the above-described technique can be used without any adverse influences.

The coercive force (Hcj) of the R-T-B-based magnet is preferably higher. In a case in which the R-T-B-based magnet is used as a magnet for motors for electric power steering such as vehicles, the coercive force is preferably 20 kOe or higher, and in a case in which the R-T-B-based magnet is used as a magnet for motors for electrical vehicles, the coercive force is preferably 30 kOe or higher. When the coercive force (Hcj) is lower than 30 kOe in a magnet for motors for electrical vehicle, there are cases in which the heat resistance is insufficient for motors.

EXAMPLES

Examples 1 to 12 and Comparative Examples 1 to 7

Nd metal (purity: 99 wt % or higher), Pr metal (purity: 99 wt % or higher), Dy metal (purity: 99 wt % or higher), ferroboron (Fe: 80 wt %, B: 20 wt %), iron metal (purity: 99 wt % or higher), Al metal (purity: 99 wt % or higher), Ga metal (purity: 99 wt % or higher), Cu metal (purity: 99 wt % or higher), Co metal (purity: 99 wt % or higher), and Zr metal (purity: 99 wt % or higher) were weighed so as to obtain the alloy compositions of alloys A to S shown in Tables 1 and 2 and were loaded into an alumina crucible.

Table 1 shows alloys not including Dy and Table 2 shows alloys including Dy.

TABLE 1

Compositions of magnet to which Dy is not added at. %

| | Alloy name | TRE | Nd | Pr | Al | Fe | Ga | Cu | Co | Zr | B |
|---|---|---|---|---|---|---|---|---|---|---|---|
| Comparative Example 1 | A | 15.34 | 11.35 | 3.99 | 0.51 | bal. | 0.48 | 0.14 | 0.99 | 0.000 | 5.16 |
| Comparative Example 2 | B | 15.29 | 11.33 | 3.96 | 0.40 | bal. | 0.47 | 0.12 | 1.04 | 0.008 | 5.14 |
| Example 1 | C | 15.30 | 11.33 | 3.96 | 0.40 | bal. | 0.47 | 0.12 | 1.04 | 0.015 | 5.16 |
| Example 2 | D | 15.32 | 11.34 | 3.98 | 0.40 | bal. | 0.50 | 0.12 | 1.04 | 0.017 | 5.18 |
| Example 3 | E | 15.32 | 11.32 | 4.00 | 0.41 | bal. | 0.50 | 0.12 | 1.05 | 0.018 | 5.17 |
| Example 4 | F | 15.35 | 11.33 | 3.97 | 0.41 | bal. | 0.48 | 0.12 | 1.03 | 0.036 | 5.19 |
| Example 5 | G | 15.32 | 11.35 | 3.97 | 0.41 | bal. | 0.48 | 0.12 | 1.00 | 0.071 | 5.15 |
| Example 6 | H | 15.34 | 11.36 | 3.98 | 0.40 | bal. | 0.47 | 0.12 | 1.02 | 0.100 | 5.16 |
| Comparative Example 3 | I | 15.41 | 11.37 | 4.03 | 0.44 | bal. | 0.49 | 0.13 | 1.00 | 0.119 | 5.19 |
| Comparative Example 4 | J | 15.32 | 11.32 | 4.00 | 0.41 | bal. | 0.50 | 0.12 | 1.05 | 0.305 | 5.17 |

TABLE 2

Compositions of magnet to which Dy is added

| | | TRE | Nd | Pr | Dy | Al | Fe | Ga | Cu | Co | Zr | at. % B |
|---|---|---|---|---|---|---|---|---|---|---|---|---|
| Comparative Example 5 | K | 14.63 | 10.19 | 3.63 | 0.81 | 0.43 | bal. | 0.48 | 0.15 | 0.99 | 0.000 | 5.33 |
| Example 7 | L | 14.65 | 10.19 | 3.63 | 0.82 | 0.43 | bal. | 0.48 | 0.15 | 0.99 | 0.015 | 5.33 |
| Example 8 | M | 14.60 | 10.15 | 3.62 | 0.83 | 0.42 | bal. | 0.48 | 0.14 | 1.00 | 0.017 | 5.34 |
| Example 9 | N | 14.66 | 10.18 | 3.64 | 0.84 | 0.42 | bal. | 0.48 | 0.15 | 0.99 | 0.018 | 5.30 |
| Example 10 | 0 | 14.66 | 10.20 | 3.63 | 0.83 | 0.42 | bal. | 0.48 | 0.14 | 0.99 | 0.026 | 5.28 |
| Example 11 | P | 14.59 | 10.16 | 3.60 | 0.83 | 0.42 | bal. | 0.48 | 0.14 | 1.00 | 0.065 | 5.36 |
| Example 12 | Q | 14.62 | 10.17 | 3.61 | 0.84 | 0.42 | bal. | 0.48 | 0.14 | 1.00 | 0.100 | 5.30 |
| Comparative Example 6 | R | 14.58 | 10.10 | 3.61 | 0.86 | 0.42 | bal. | 0.48 | 0.13 | 0.99 | 0.117 | 5.40 |
| Comparative Example 7 | S | 14.57 | 10.12 | 3.62 | 0.83 | 0.41 | bal. | 0.47 | 0.14 | 0.99 | 0.399 | 5.35 |

After that, the alumina crucible was installed in a high-frequency vacuum induction furnace, and the inside of the furnace was substituted with Ar. In addition, the alloy was melted by heating the high-frequency vacuum induction furnace to 1450° C., thereby producing a molten alloy. After that, the molten alloy was poured into a water-cooling copper roll, and a cast alloy was cast using a strip casting (SC) method. At this time, the rotating speed of the water-cooling copper roll was set to 1.0 m/second, and the average thickness of the molten alloy was set to approximately 0.3 mm. After that, the cast alloy was crushed, thereby obtaining cast alloy thin pieces.

Next, the cast alloy thin pieces were decrepitated using a hydrogen decrepitation method described below. First, the cast alloy thin pieces were coarsely crushed so that the diameter reached approximately 5 mm and were placed in hydrogen at room temperature, whereby hydrogen was adsorbed into the cast alloy thin pieces. Subsequently, a heat treatment in which the cast alloy thin pieces that had been coarsely crushed and absorbed hydrogen were heated up to 300° C. in hydrogen was carried out. After that, hydrogen between lattices in the main phase was degassed by reducing the pressure, furthermore, a heat treatment in which the cast alloy thin pieces were heated up to 500° C. was carried out so as to discharge and remove hydrogen in the grain boundary phase, and the cast alloy thin pieces were cooled to room temperature and decrepitated.

Next, 0.025 wt % of zinc stearate was added as a lubricant to the hydrogen-decrepitated cast alloy thin pieces, and the hydrogen-decrepitated cast alloy thin pieces were finely crushed to an average grain size (d50) of 4.5 μm using a jet mill (HOSOKAWA MICRON 100 AFG) and high-pressure nitrogen of 0.6 MPa, thereby obtaining R-T-B-based alloy powder.

Next, 0.02% by mass to 0.03% by mass of zinc stearate was added as a lubricant to the R-T-B-based alloy powder obtained in the above-described manner and was pressed using a shaping machine in a transverse magnetic field at a shaping pressure of 0.8 t/cm$^2$ thereby producing a compact.

After that, the compact made of the alloy was installed in a carbon tray, the tray including the compact was disposed in a heat treatment furnace, and the pressure was reduced to 0.01 Pa. Subsequently, the compact was heat treated at 500° C. in order to remove an organic substance, was heat treated at 800° C. in order to decompose a hydroxide, and was heat treated at a temperature in a range of 1000° C. to 1100° C. in order for sintering, thereby obtaining a sintered body (sintering process).

After that, the sintered body was heat treated at two different temperatures of 800° C. and 500° C. and was cooled, thereby obtaining R-T-B-based magnets of Examples 1 to 12 and Comparative Examples 1 to 7.

Next, the magnetic properties of each of the R-T-B-based magnets obtained in Examples 1 to 12 and Comparative Examples 1 to 7 were measured using a pulse-type BH curve tracer (TPM2-10, Toei Industry Co., Ltd.). The results are shown in Table 3.

TABLE 3

List of Coercive force and Hk/Hcj

| | Alloy name | Coercive force (kOe) | Hk/Hcj |
|---|---|---|---|
| Comparative Example 1 | A | 18.56 | 0.48 |
| Comparative Example 2 | B | 20.05 | 0.63 |
| Example 1 | C | 20.17 | 0.92 |
| Example 2 | D | 20.19 | 0.92 |
| Example 3 | E | 20.22 | 0.92 |
| Example 4 | F | 19.74 | 0.91 |
| Example 5 | G | 19.64 | 0.91 |
| Example 6 | H | 19.57 | 0.90 |
| Comparative Example 3 | I | 19.45 | 0.89 |
| Comparative Example 4 | J | 19.20 | 0.88 |
| Comparative Example 5 | K | 19.91 | 0.88 |
| Example 7 | L | 21.75 | 0.90 |
| Example 8 | M | 21.92 | 0.91 |
| Example 9 | N | 22.15 | 0.92 |
| Example 10 | O | 22.30 | 0.92 |
| Example 11 | P | 22.04 | 0.92 |
| Example 12 | Q | 21.80 | 0.92 |
| Comparative Example 6 | R | 21.60 | 0.92 |
| Comparative Example 7 | S | 21.30 | 0.90 |

In Table 3, "Hcj" represents the coercive force, and "Hk/Hcj" represents squareness based on the ratio between Hk computed as H at which Br ("Br" represents remanence) reached 90% and Hcj. These magnetic property values are respectively the averages of values measured from three R-T-B-based magnets.

Figure 2:
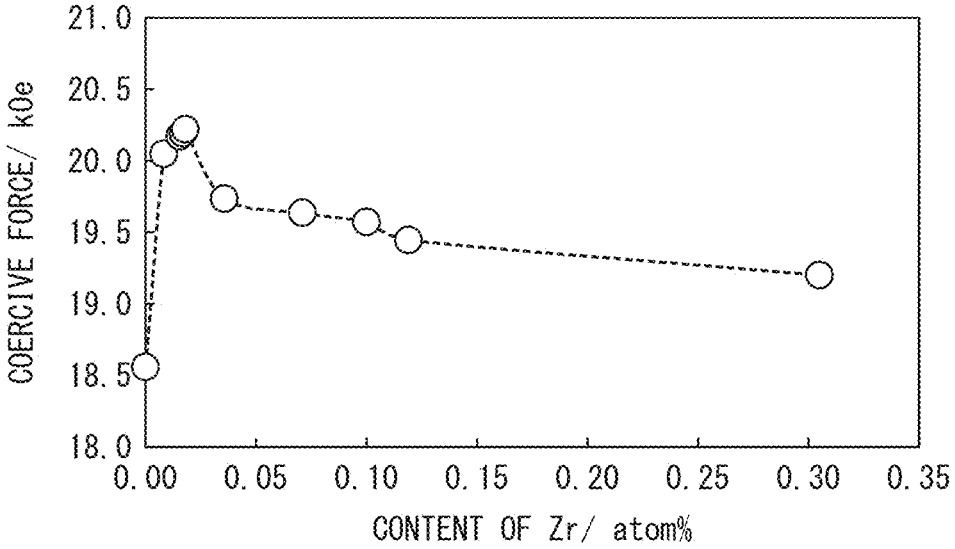
FIG. 2 is a graph illustrating a relationship between the amount of Zr and a coercive force in Examples 1 to 6 and Comparative Examples 1 to 4 which are R-T-B-based magnets to which Dy is not added.

FIG. 2 is a graph illustrating the relationship between the amount of Zr and the coercive force in Examples 1 to 6 and Comparative Examples 1 to 4 which were R-T-B-based magnets to which Dy was not added.

From FIG. 2, it is found that the coercive force gradually increases as the amount of Zr decreases from 0.305 atom %, reaches the maximum at approximately 0.02 atom %, and abruptly decreases as the amount of Zr decreases from 0.01 atom %. It is found that there is a range of the concentration of Zr in which a particularly high coercive force is exhibited at approximately 0.02 atom %.

Figure 3:
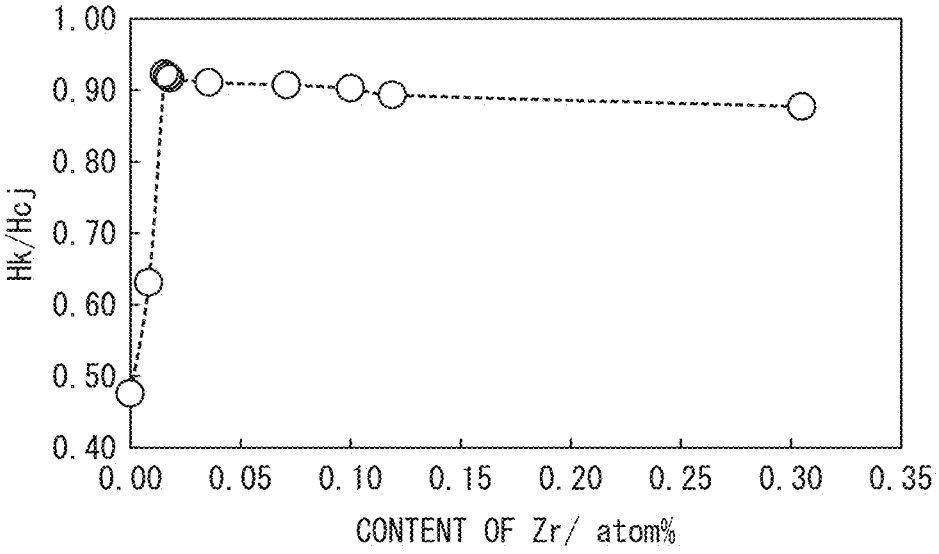
FIG. 3 is a graph illustrating a relationship between the amount of Zr and squareness (Hk/Hcj) in Examples 1 to 6 and Comparative Examples 1 to 4 which are R-T-B-based magnets to which Dy is not added.

FIG. 3 is a graph illustrating the relationship between the amount of Zr and the squareness (Hk/Hcj) in Examples 1 to 6 and Comparative Examples 1 to 4 which are R-T-B-based magnets to which Dy was not added.

From FIG. 3, it is found that the squareness (Hk/Hcj) gradually increases as the amount of Zr decreases from 0.305 atom %, reaches the maximum at approximately 0.02 atom %, and abruptly decreases as the amount of Zr decreases from 0.015 atom %. It is found that there is a range of the concentration of Zr in which the squareness is particularly favorable at approximately 0.02 atom %. Practically, the squareness is preferably 0.9 or higher.

Figure 4:
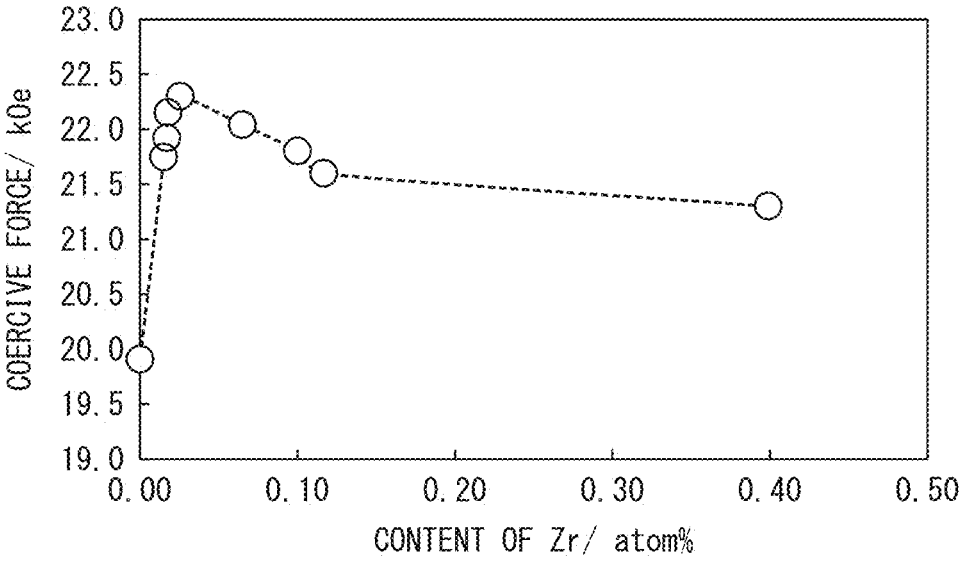
FIG. 4 is a graph illustrating a relationship between the amount of Zr and a coercive force in Examples 7 to 12 and Comparative Examples 5 to 7 which are R-T-B-based magnets to which Dy is added.

FIG. 4 is a graph illustrating the relationship between the amount of Zr and the coercive force in Examples 7 to 12 and Comparative Examples 5 to 7 which are R-T-B-based magnets to which Dy was added.

From FIG. 4, it is found that the coercive force gradually increases as the amount of Zr decreases from 0.399 atom %, reaches the maximum at approximately 0.03 atom %, becomes approximately equal at 0.015 atom % to the coercive force obtained at 0.10 atom %, and significantly decreases as the amount of Zr decreases from 0.015 atom %. It is found that, even in the R-T-B-based magnets to which Dy was added, the coercive force reaches the maximum at approximately the same amount of Zr as that in the R-T-B-based magnets to which Dy was not added.

Figure 5:
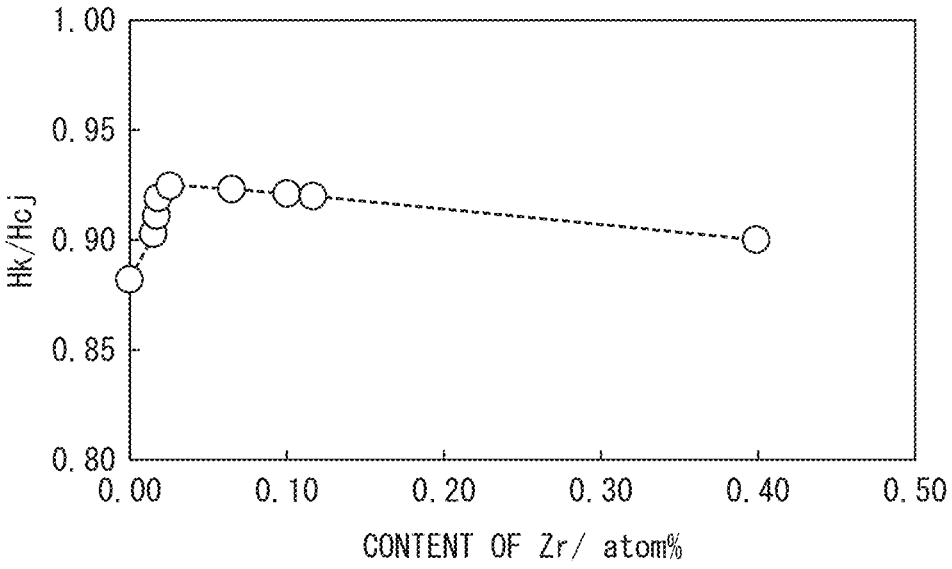
FIG. 5 is a graph illustrating a relationship between the amount of Zr and squareness (Hk/Hcj) in Examples 7 to 12 and Comparative Examples 5 to 7 which are R-T-B-based magnets to which Dy is added.

FIG. 5 is a graph illustrating the relationship between the amount of Zr and the squareness (Hk/Hcj) in Examples 7 to 12 and Comparative Examples 5 to 7 which are R-T-B-based magnets to which Dy was added.

From FIG. 5, it is found that the squareness (Hk/Hcj) is maintained at a high level even when the amount of Zr decreases from 0.399 atom %, begins to decrease at slightly less than 0.02 atom %, reaches 0.9 at 0.015 atom %, and monotonously decreases from 0.015 atom % to 0 atom % at which the squareness reaches 0.88.

After each of the samples of the R-T-B-based magnets was polished, the polished surface was observed using a field-emission electron probe micro analyzer (FE-EPMA), and a composition mapping analysis was carried out.

Figure 6:
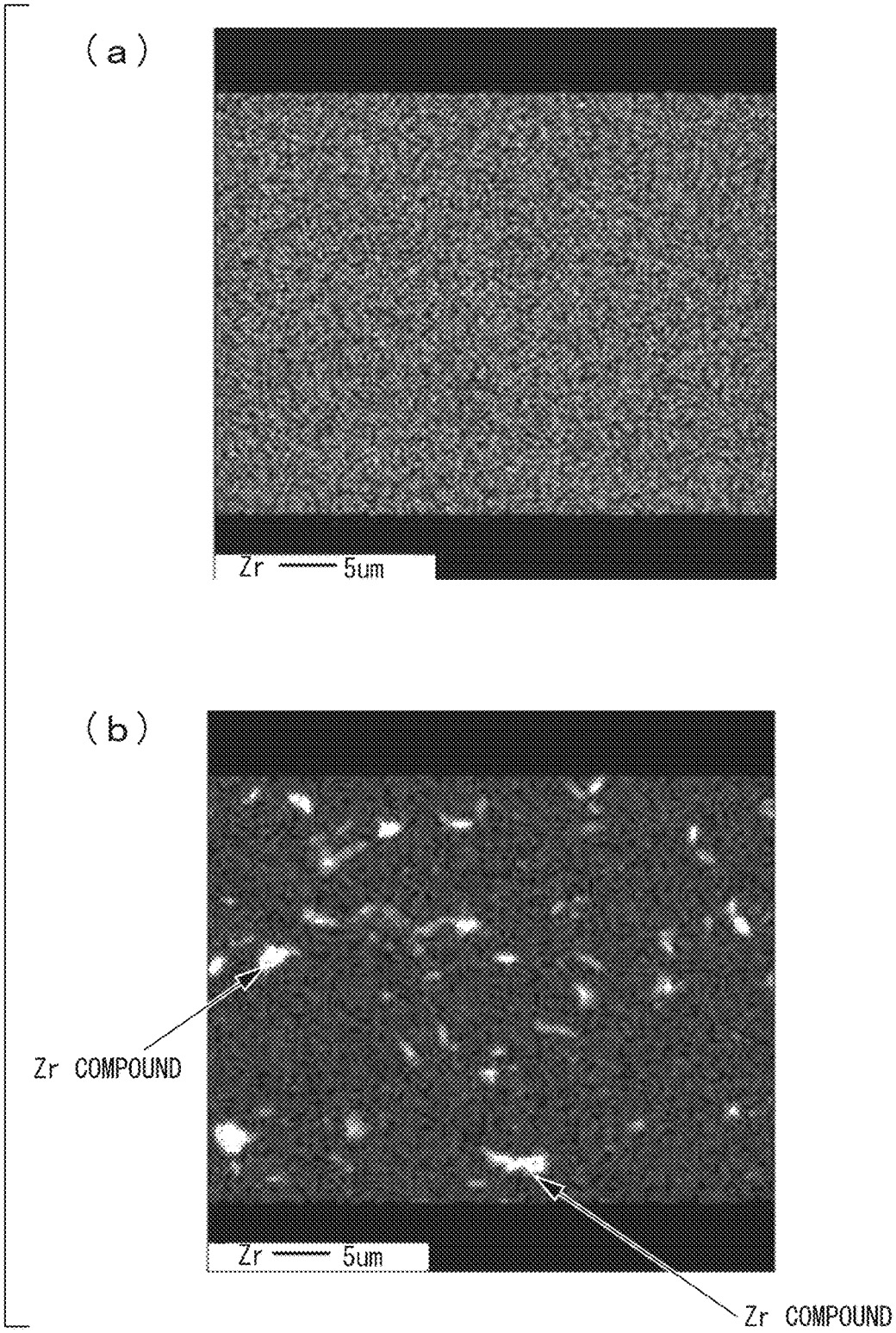
FIG. 6 illustrates observation results by means of FE-EPMA in which (a) illustrates an observation result of Example 1 and (b) illustrates an observation result of Comparative Example 3.

FIGS. 6(*a*) and 6(*b*) illustrate observation results by means of FE-EPMA, FIG. 6(*a*) illustrates the observation result of Example 1, and FIG. 6(*b*) illustrates the observation result of Comparative Example 3.

As illustrated in FIG. 6(*b*) using arrows, a number of bright spots corresponding to a compound including Zr and boron (B) are observed in the grain boundary phase, whereas, in FIG. 6(*a*), bright spots corresponding to the above-described compound are not observed.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 . . . manufacturing apparatus, 2 . . . casting device, 3 . . . heating device, 4 . . . storage container, 5 . . . container, 6 . . . chamber, 6*a* . . . casting chamber, 6*b* . . . heat retention and storage chamber, 7 . . . hopper, 21 . . . crushing device, 31 . . . heating heater, 32 . . . openable stage group, 33 . . . openable stage.

What is claimed is:

1. An R-T-B-based rare earth sintered magnet, comprising
- a rare earth element R, B, a metallic element M which includes one or more metals selected from Al, Ga and Cu, a transition metal T which includes Fe as a main component, and inevitable impurities, wherein
  - the sintered magnet includes
  - 13 atom % to 15.5 atom % of R,
  - 5.0 atom % to 6.0 atom % of B,
  - 0.1 atom % to 2.4 atom % of M,
  - 0.1 atom % or more of Ga, and
  - T and the inevitable impurities as a balance,
- and wherein
  - the sintered magnet includes 0.015 atom % to 0.04 atom % of Zr as the transition metal T, and
  - the Zr does not form a compound with the B in a grain boundary phase.

2. The R-T-B-based rare earth sintered magnet according to claim 1, wherein the sintered magnet satisfies the following formula (1):

$$0.32 \leq B/TRE \leq 0.40 \quad (1)$$

wherein, in the formula (1), B represents a concentration (atom %) of a boron element and TRE represents a concentration (atom %) of total rare earth elements.

3. The R-T-B-based rare earth sintered magnet according to claim 1, wherein the grain boundary phase is present in a grain boundary of a main phase.

4. The R-T-B-based rare earth sintered magnet according to claim 1, wherein the R-T-B-based magnet includes
- a main phase made of $R_2T_{14}B$ and
- the grain boundary phase, wherein
  - the grain boundary phase includes a larger amount of R than the main phase, and
  - the grain boundary phase includes
    - an R-rich phase and
    - a transition metal-rich phase which has a lower concentration of R and a higher concentration of transition metal elements than the R-rich phase.

5. The R-T-B-based rare earth sintered magnet according to claim 4, wherein
- the R-rich phase has 50 atom % or higher of the total atomic concentration of rare earth elements, and
- the transition metal-rich phase has 25 to 35 atom % of the total atomic concentration of rare earth elements.

6. The R-T-B-based rare earth sintered magnet according to claim 1, wherein a compound including Zr and B is not included in the grain boundary phase.

7. The R-T-B-based rare earth sintered magnet according to claim 1, wherein the sintered magnet includes 0.47 to 0.50 atom % of Ga.

8. The R-T-B-based rare earth sintered magnet according to claim 1, wherein the sintered magnet includes 0.47 atom % or more of Ga.

9. An alloy for an R-T-B-based rare earth sintered magnet, comprising:
- a rare earth element R, B, a metallic element M which includes one or more metals selected from Al, Ga and Cu, a transition metal T which includes Fe as a main component, and inevitable impurities,
  - wherein the sintered magnet includes
  - 13 atom % to 15.5 atom % of R,
  - 5.0 atom % to 6.0 atom % of B, 0.1 atom % to 2.4 atom % of M, 0.1 atom % or more of Ga, and T and the inevitable impurities as a balance, and wherein the sintered magnet includes 0.015 atom % to 0.04 atom % of Zr as the transition metal T, and the Zr does not form a compound with the B in a grain boundary phase.

10. The alloy for an R-T-B-based rare earth sintered magnet according to claim 9, wherein the sintered magnet satisfies the following formula (1):

$$0.32 \leq B/TRE \leq 0.40 \quad (1)$$

wherein, in the formula (1), B represents a concentration (atom %) of a boron element and TRE represents a concentration (atom %) of total rare earth elements.

* * * * *